US009518346B2

(12) United States Patent
Omata et al.

(10) Patent No.: US 9,518,346 B2
(45) Date of Patent: Dec. 13, 2016

(54) SEWING MACHINE PROVIDED WITH ZIGZAG MOTION MECHANISM

(71) Applicant: Janome Sewing Machine Co., Ltd., Tokyo (JP)

(72) Inventors: Yukitaka Omata, Tokyo (JP); Ryosuke Suzuki, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 14/624,718

(22) Filed: Feb. 18, 2015

(65) Prior Publication Data

US 2015/0376824 A1 Dec. 31, 2015

(30) Foreign Application Priority Data

Jun. 30, 2014 (JP) ..... 2014-134802

(51) Int. Cl.

| | |
|---|---|
| ***D05B 27/22*** | (2006.01) |
| ***D05B 3/02*** | (2006.01) |
| ***D05B 19/00*** | (2006.01) |
| ***D05B 19/14*** | (2006.01) |

(52) U.S. Cl.

CPC ..... *D05B 3/02* (2013.01); *D05B 19/00* (2013.01); *D05B 19/14* (2013.01)

(58) Field of Classification Search

CPC ..... D05B 3/02; D05B 19/00; D05B 19/003; D05B 19/12; D05B 19/14

USPC ..... 112/464

See application file for complete search history.

(56) References Cited

U.S. PATENT DOCUMENTS

| | | | | |
|---|---|---|---|---|
| 2,887,967 A | | 5/1959 | Kasper et al. | |
| 2,929,344 A | | 3/1960 | Theenhausen et al. | |
| 3,094,085 A | | 6/1963 | Szuba et al. | |
| 3,313,257 A | * | 4/1967 | Kasuga | D05B 19/00 112/452 |
| 3,412,700 A | * | 11/1968 | Marforio | D05B 1/10 112/248 |

(Continued)

FOREIGN PATENT DOCUMENTS

| | | |
|---|---|---|
| JP | 58-31157 A | 2/1983 |
| JP | 2013-46718 A | 3/2013 |

OTHER PUBLICATIONS

British communication dated Jul. 17, 2015 in corresponding British patent application No. GB1501920.1.

*Primary Examiner* — Nathan Durham

(74) *Attorney, Agent, or Firm* — Nields, Lemack & Frame, LLC

(57) ABSTRACT

A zigzag width range setting apparatus 9 sets a minimum value and a maximum value of a zigzag width of a needle 62. When the sewing machine is in operation, if the minimum value of the zigzag width preset by the zigzag width range setting apparatus 9 is higher than 0, a zigzag action is performed in a minimum zigzag width at no operation of a knee lifter 2 (an amount of operation of zero), and if the minimum value is 0, the zigzag width of the needle 62 is 0 at zero amount of operation of the knee lifter 2, that is the zigzag action is not performed, and stitching is performed by moving the needle 62 widthwise in accordance with the amount of operation of the knee lifter 2. If the maximum value is changed by the zigzag width range setting apparatus 9 during the sewing machine stitch action, zigzag stitch in accordance with the changed maximum zigzag width is performed.

8 Claims, 11 Drawing Sheets

(56) References Cited

U.S. PATENT DOCUMENTS

| | | | | |
|---|---|---|---|---|
| 4,052,947 | A * | 10/1977 | Papajewski | D05B 3/02 112/464 |
| 6,065,411 | A * | 5/2000 | Kuramoto | D05B 3/02 112/464 |
| 7,963,239 | B2 * | 6/2011 | Ishii | D05B 3/02 112/157 |
| 2009/0050038 | A1 | 2/2009 | Ishii et al. | |

* cited by examiner

Fig. 3

| | USER SETTING OF AMOUNT OF ZIGZAG NEEDLE MOTION | |
|---|---|---|
| | MINIMUM (mm) | MAXIMUM (mm) |
| A | 1 | 9 |
| B | 2 | 7 |
| C | 3 | 5 |

SEWING MACHINE PROVIDED WITH ZIGZAG MOTION MECHANISM

TECHNICAL FIELD

The present invention relates to a sewing machine provided with a zigzag motion mechanism.

BACKGROUND ART

In a sewing machine stitch, a stitching method called "free motion stitch" is known. In this free motion stitch, a cloth feeding motion of the sewing machine is disabled, and the cloth feeding is not performed, and an operator moves the cloth freely to achieve the sewing machine stitch. In the sewing machine provided with a zigzag motion mechanism for zigzag stitch, a wide variety of free motion stitches is achieved by adding the zigzag stitch.

In the free motion stitch, since the operator moves the cloth with both hands, speed of the sewing machine is adjusted by a foot controller.

Adjustment of the extent of the zigzag width (zigzag needle motion width) that is, an amplitude value is normally performed with an operating device referred to as "knee lifter" that can be operated by a knee. By the operation of the knee lifter, the width of zigzag stitch is adjusted.

CITATION LIST

Patent Literature

[PTL 1] JP-A-58-31157
[PTL 2] JP-A-2013-46718

SUMMARY OF THE INVENTION

Technical Problem

When performing the free motion stitch in the sewing machine capable of the above-described zigzag (zigzag needle motion) stitch, the zigzag width is limited by the mechanism of the sewing machine, and is ranged normally from 0 mm to approximately 9 mm. Though some users require to control the zigzag width finely, the prior sewing machines cannot achieve the fine adjustment of the zigzag width with the operating device such as the knee lifter.

Further there is a need of stitching so as to keep the same zigzag width, but in the prior sewing machines, the operation of the knee lifter is difficult so as to keep the same zigzag width. In particular, when the operation of the knee lifter is performed in a mid-section, for example, when a zigzag stitch of 5 mm is performed with a sewing machine having a maximum zigzag width of 9 mm, there is a problem that it may be difficult to keep the knee lifter constantly at a position in a width of 5 mm and the zigzag width cannot be kept constant. There is also a problem that the zigzag width is gradually increased or decreased, and hence the zigzag stitch cannot be sewed stably, tightly and beautifully.

There is also a problem that in a state in which the knee lifter is not operated at all, only a straight stitch is allowed and the zigzag stitch cannot be sewed.

The present invention is provided in order to solve the above-described problems.

Solution to Problem

In order to achieve the above-described object, the sewing machine of the invention comprises: a zigzag motion mechanism for causing a zigzag needle motion, an operating apparatus operated by an operator for controlling a zigzag width of a zigzag needle motion by the zigzag motion mechanism, an operation detecting apparatus for detecting an operation of the operating apparatus and an amount of the operation thereof, a zigzag width range setting apparatus for setting a range of zigzag width that can be operated by the operating apparatus, and a zigzag needle motion controller for controlling the zigzag motion mechanism when the operation of the operating apparatus is detected by the operation detecting apparatus, and causing the zigzag motion mechanism to perform the zigzag needle motion in accordance with the amount of operation and within the zigzag width range set by the zigzag width range setting apparatus.

The zigzag width range setting apparatus may be configured to set a maximum value of the zigzag width or to set a minimum value of the zigzag width. In the preferred embodiment, a configuration in which both of the maximum value and the minimum value are controlled is desirable.

The operating apparatus is typically a knee lifter configured to be operated by the operator by using his or her knee. However, the operating apparatus of other configuration is also applicable.

Said controller may control zigzag width of the zigzag motion mechanism linearly to the amount of operation of the operating apparatus within the zigzag width range, or an operation range in which zigzag width of the zigzag motion mechanism is constant with respect to the amount of operation of the operating apparatus can be provided.

In addition, a sewing machine operating speed controller for controlling an operating speed of the sewing machine corresponding to the zigzag width of the zigzag needle motion of the zigzag motion mechanism may be provided as well.

In addition to the above-described configuration, the invention of claim 9 further comprises a presser lifting mechanism, a state detecting apparatus for detecting whether a needle of the sewing machine is in an operating state or in a stop state, and a presser controller for controlling the presser lifting mechanism to move a presser foot upward and downward in accordance with the operation if the needle of the sewing machine is detected to be in the stop state by the state detecting device when the operation of the operating apparatus is detected by the operation detecting apparatus, wherein said zigzag needle motion controller controls the zigzag motion mechanism to cause the zigzag needle motion in accordance with said amount of operation if the needle of the sewing machine is detected to be in the operating state by the state detecting device when the operation of the operating apparatus is detected by the operation detecting apparatus.

Advantageous Effects of Invention

According to the sewing machine of the present invention, since the zigzag width range, which is a range of the amplitude that can be operated by the operating apparatus, can be set by the zigzag width range setting apparatus, the zigzag width can be controlled stably by the operating apparatus within a zigzag width range required by the operator, so that stable stitching can be performed.

Since the maximum or minimum zigzag width can be set, a stable zigzag stitch can be performed in the preset maximum or minimum zigzag width if a maximum width operation or a minimum width operation is performed by the operating apparatus.

In particular, when the knee lifter is used as the operating apparatus, a user can stitch in the arbitrary preset maximum or minimum zigzag width (the amount of zigzag needle motion) by rotating the knee lifter to the position at the maximum or minimum amount of operation, that is, a lower limit position (zero position) or an upper position (MAX position) where the pivotal motion of the knee lifter is stopped. Therefore, stitching of the zigzag stitch with a constant zigzag width is achieved without fine-adjusting the knee lifter. The lower limit position (zero position) of the knee lifter is a position where the operation of the knee lifter is not performed, and hence the zigzag stitch can be performed in the minimum zigzag width without performing the operation of the knee lifter.

In the configuration of claim 9, since the operations of the zigzag motion mechanism and the presser lifting mechanism may be performed with the identical operating apparatus, the quantity of operating apparatuses can be reduced and the working load of the operator can be eased.

In the case where the sewing machine operating speed controller for controlling the operating speed of the sewing machine corresponding to the zigzag width of the zigzag needle motion by the zigzag motion mechanism is provided, an advantage that the workability is dramatically improved when the free motion stitch is performed is achieved.

BRIEF DESCRIPTION OF DRAWINGS

FIG. 3 A table showing an example of a zigzag width preset by the zigzag width setting apparatus of the present invention.

DESCRIPTION OF EMBODIMENTS

Hereafter embodiments of the invention will be described with reference to the drawings.

Figure 1:
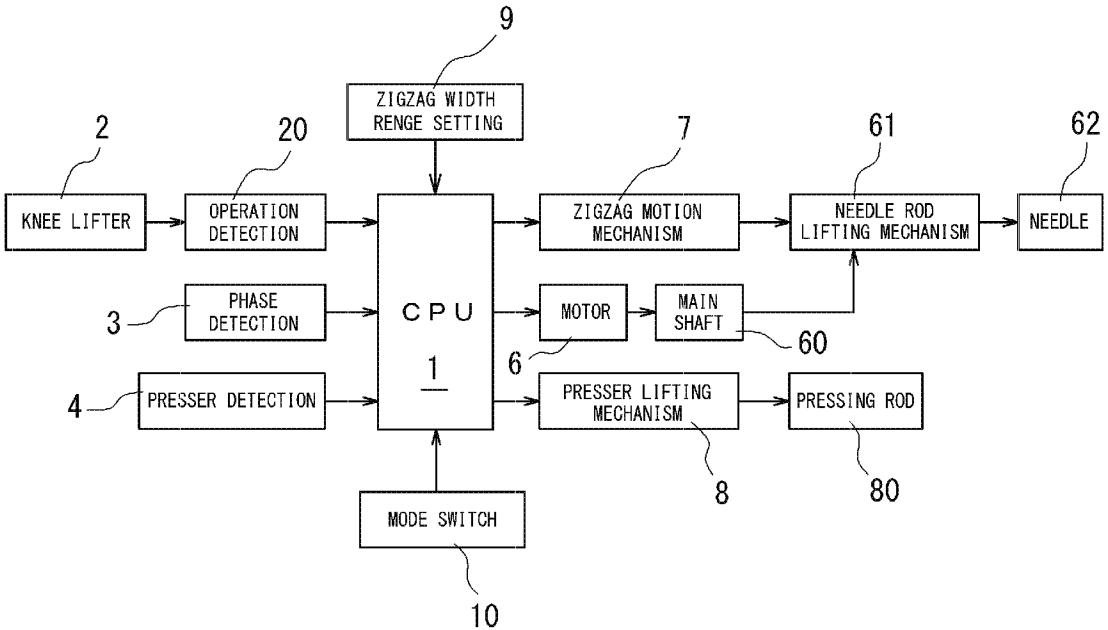
FIG. 1 A block diagram illustrating an embodiment of the present invention.

In FIG. 1, a controller 1 controls an entire part of a sewing machine, and an operation detecting apparatus 20 detects an operation and an amount of operation of a knee lifter 2 as an operating apparatus and inputs them to the controller 1.

The controller 1 further receives a signal from a upper shaft phase detecting apparatus 3 as a state detection apparatus to detect the state whether the sewing machine is operated or is stopped, so as to recognize whether the sewing machine is in a stop state or in an operating state. In addition, a stitching speed of the sewing machine can also be detected.

The controller 1 further receives an input of a signal from a presser detecting apparatus 4 and detects the state of a presser lifting mechanism 8, that is, whether the presser mechanism 8 is in an upper position or in a lower position.

Figure 7:
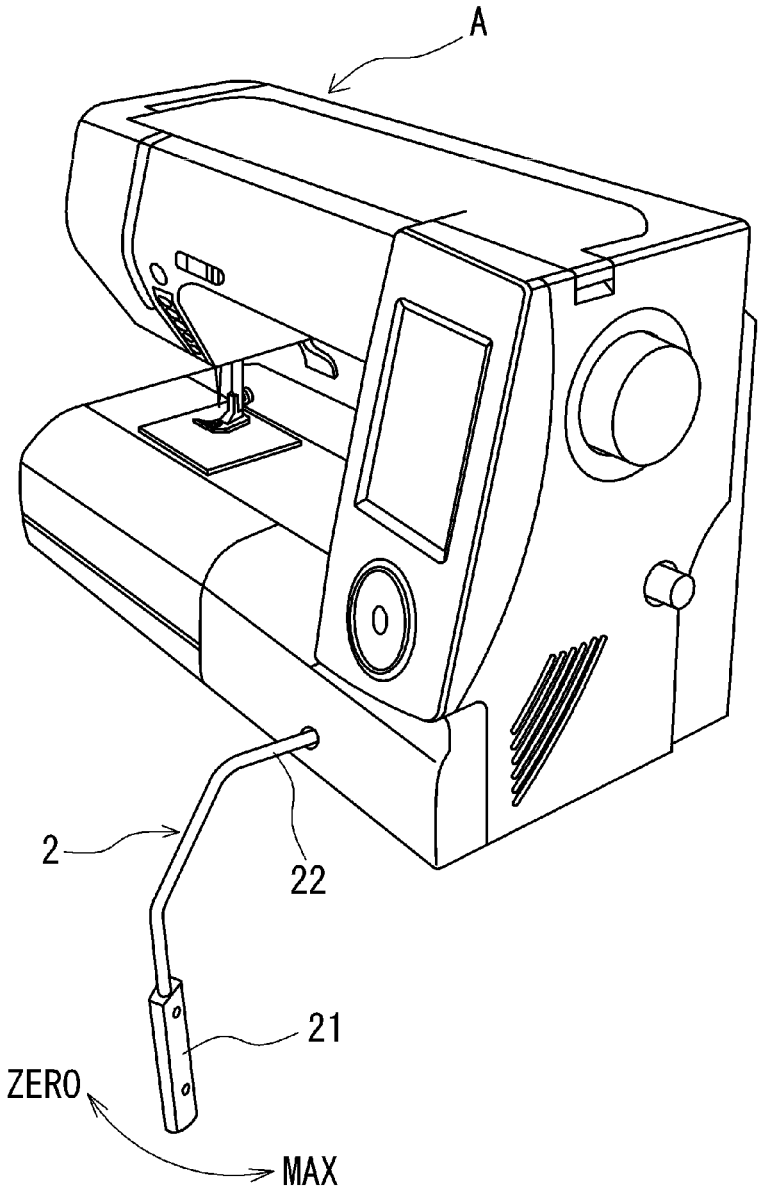
FIG. 7 An explanatory drawing illustrating the knee lifter of the embodiment of the present invention.
Figure 8:
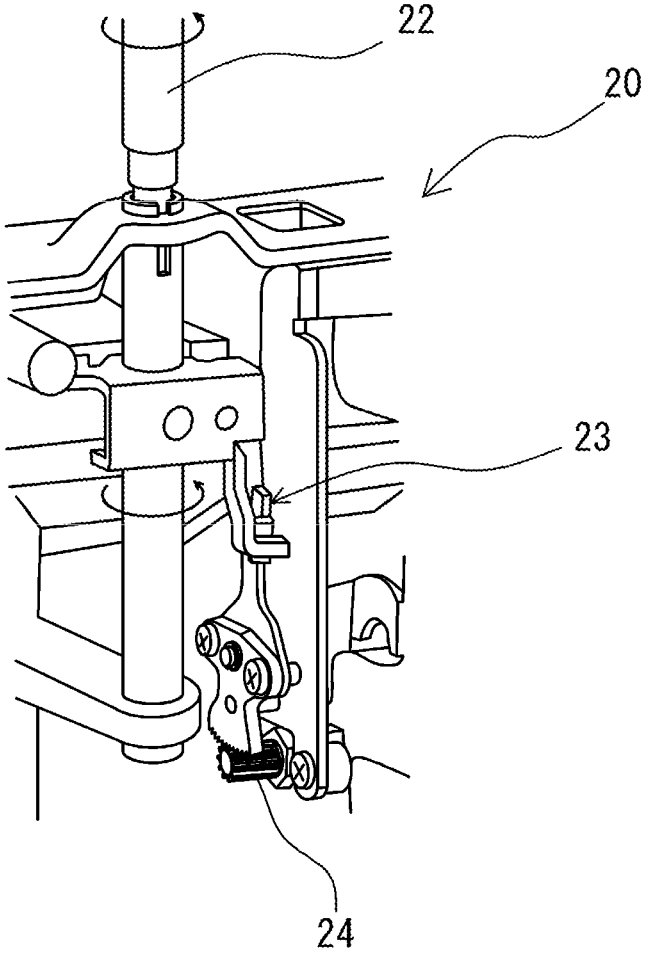
FIG. 8 A perspective view illustrating a mechanism of the knee lifter of the embodiment of the present invention.
Figure 9:
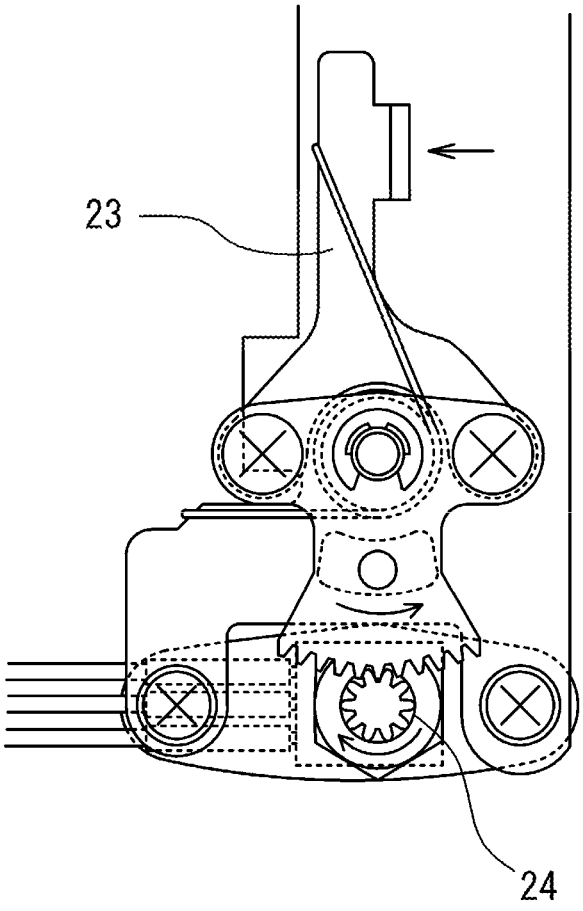
FIG. 9 A partial drawing illustrating the knee lifter mechanism of the embodiment of the present invention.

In FIG. 7, the knee lifter 2 has an L-shape including a knee pad portion 21 and a lever 22, the lever 22 is provided so as to project toward a front side from a base on a front surface of a sewing machine body A, and the knee pad portion 21 has a shape bent from the lever 22 downward by 90 degrees. By an operation of the knee pad portion 21 by an operator by using his or her knee, the lever 22 pivots and activates the operation detecting apparatus 20 provided in the interior of the sewing machine body A as illustrated in FIGS. 8 and 9. The pivotal motion of the lever 22 drives a link mechanism 23, drives a potentiometer 24 configured to engage the link mechanism 23, thereby the operation and the amount of operation of the knee lifter 2 are detected. The lever 22, the link mechanism 23, and the potentiometer 24 constitute the operation detecting apparatus 20.

The knee lifter 2 is pivotable with the knee motion from a position where no operation is performed (ZERO position) to a position that is a mechanical limit of operation (MAX position), and the lever 22 pivots in association with the pivotal motion of the knee lifter 2. This amount of pivotal motion may be detected by the operation detecting apparatus 20. The knee lifter 2 is configured to take the zero position when the operator does not operate.

The zigzag width of a zigzag motion mechanism 7 is controlled in accordance with the amount of operation of the knee lifter 2 (the amount of pivotal motion of the lever 22). Therefore the zigzag motion mechanism 7 performs the zigzag motion in the minimum zigzag width when the knee lifter 2 is at the zero position and in the maximum zigzag width when the knee lifter 2 is at the MAX position.

The controller 1 is controls ON/OFF and the stitching speed of the sewing machine by sending a signal to a motor 6 and controlling the rotation speed of the motor 6. The motor 6 drives a needle rod lifting mechanism 61 via a main shaft 60, and performs stitching by moving a needle 62 upward and downward.

In addition, upon reception of a signal of the operation of the knee lifter 2 from the operation detecting apparatus 20, the controller 1 sends a signal to the presser lifting mechanism 8, moves a presser bar 80 upward and downward to move a presser foot 81 upward and downward.

As described above, the controller 1 controls the zigzag motion mechanism 7 to move the needle rod lifting mechanism 61 in the width direction to achieve the zigzag stitch. The amplitude, i.e. zigzag width varies in accordance with the amount of operation of the knee lifter 2 from the operation detecting apparatus 20 as described above.

Figure 10:
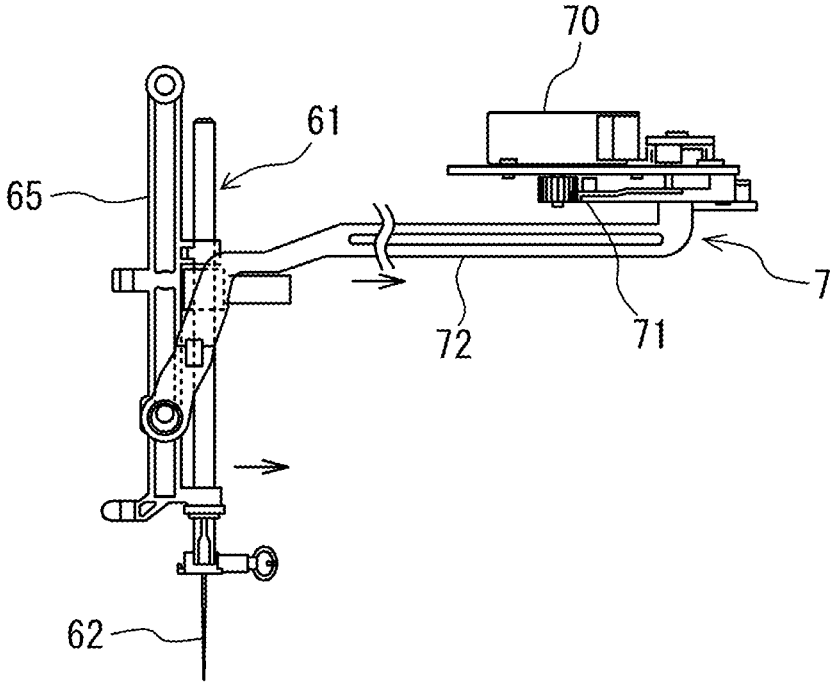
FIG. 10 An explanatory drawing illustrating a zigzag motion mechanism of the embodiment of the present invention.

In FIG. 10, the needle rod lifting mechanism 61 is supported by a needle rod supporting member 65 and moves upward and downward to cause the needle 62 to perform stitching and to perform the zigzag stitch in the width direction by the zigzag motion mechanism 7. The zigzag motion mechanism 7 is provided with a zigzag motion motor 70 that moves a zigzag motion rod 72 via a zigzag motion gear 71 and moves the needle rod lifting mechanism 61 in the width direction.

Figure 11:
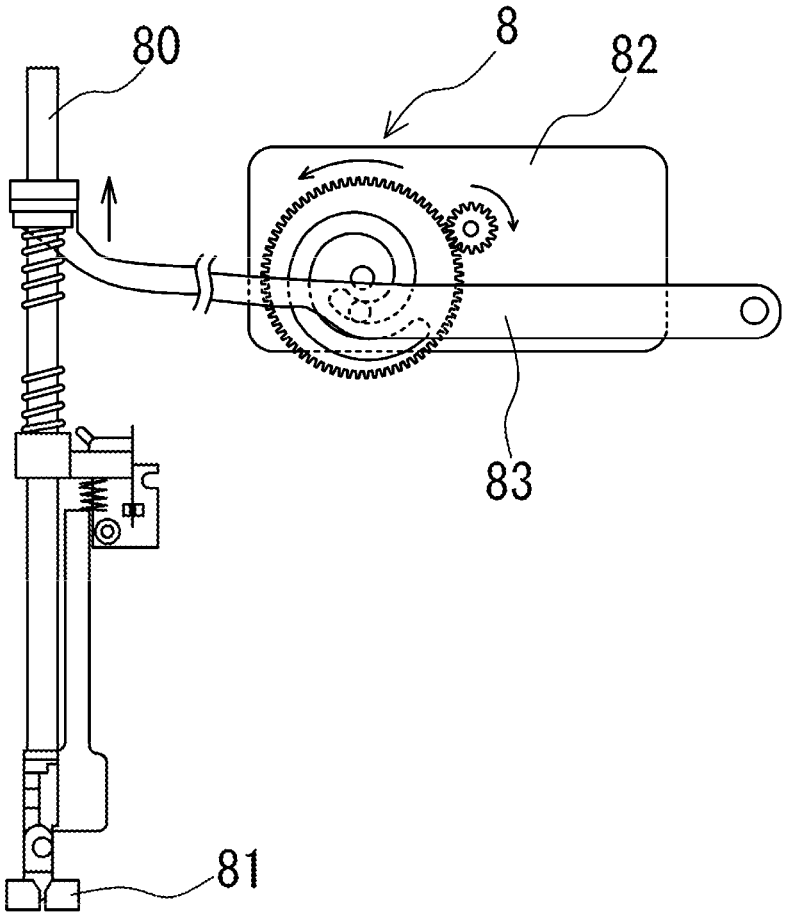
FIG. 11 An explanatory drawing illustrating a presser lifting mechanism of the embodiment of the present invention.

FIG. 11 illustrates the presser lifting mechanism 8 in detail. The presser foot 81 is mounted on a lower end of the presser bar 80 that can be moved upward and downward, and the presser foot 81 is moved downward to press the cloth. The presser lifting mechanism 8 includes a stepping motor 82 and a lever 83 that moves upward and downward by driving of the stepping motor 82. The lever 83 engages the presser bar 80 to move the presser bar 80 upward and downward.

A zigzag width range setting apparatus 9 is connected to the controller 1. By the apparatus 9 a minimum value and a maximum value of an amount of zigzag needle motion (a zigzag width) of the needle 62 by the zigzag motion mechanism 7 can be set. Thus the range of the zigzag width controllable and adjustable by the knee lifter 2 can be set.

Figure 2:
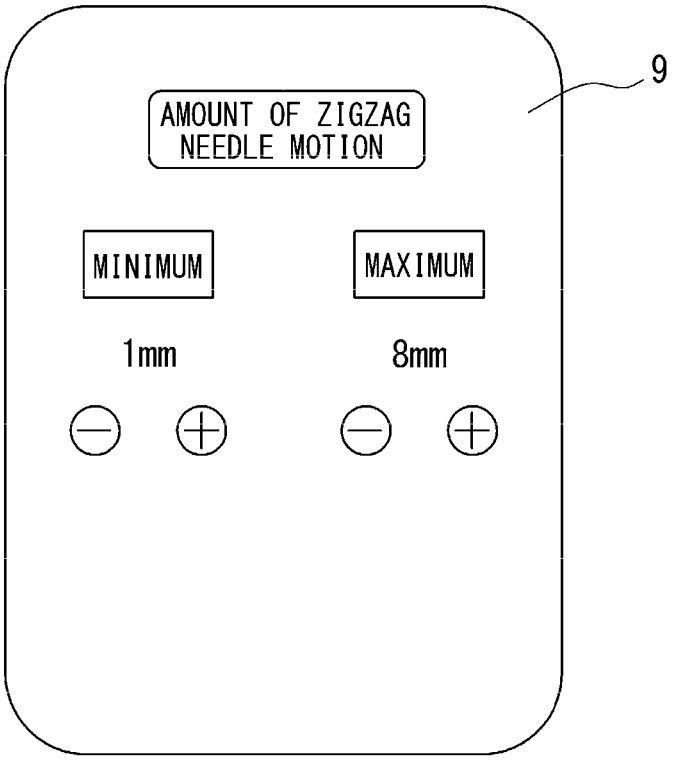
FIG. 2 An explanatory drawing illustrating an embodiment of a zigzag width setting apparatus of the present invention.

FIG. 2 illustrates a display screen of the zigzag width range setting apparatus 9. An example in which the zigzag width is set to 1 mm as a minimum value, and 8 mm as a maximum value is illustrated.

In the example, the zigzag stitch in a zigzag width of 1 mm is performed with the knee lifter 2 located at the ZERO position (the position not operated), and the zigzag stitch in a zigzag width of 8 mm is performed with the knee lifter 2 at the MAX position.

In this embodiment, a range in which the zigzag motion mechanism 7 can perform the zigzag needle motion is structurally 9 mm at a maximum (an absolute maximum value) and 0 mm at a minimum (an absolute minimum value). Therefore, if the maximum value and the minimum value are not set by the zigzag width range setting apparatus 9, the zigzag width can be controlled from 0 mm to 9 mm by the knee lifter 2.

By setting the range of the controllable zigzag width, the user can control the zigzag width stably within the range of the required zigzag width.

When the minimum value is set, the controller 1 performs the zigzag stitch in the preset minimum zigzag width at zero operation of the knee lifter 2, the operator can perform the zigzag stitch at the minimum value without operating the knee lifter 2.

When the maximum value is set, the zigzag stitch is performed in the maximum zigzag width at the MAX position of the knee lifter 2 and the operator does not need to adjust the amount of operation of the knee lifter 2, and needs only to fix the knee lifter 2 at the MAX position to obtain the zigzag stitch with high stability at the preset maximum zigzag width.

Figure 4:
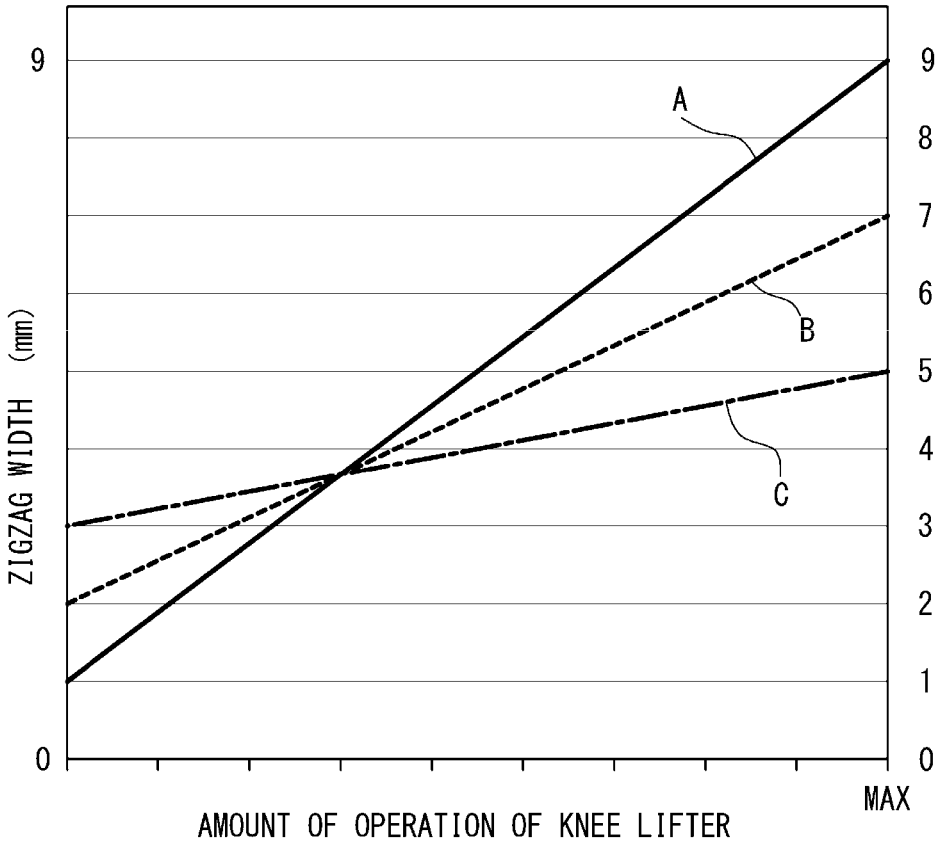
FIG. 4 A graph illustrating a relationship between an amount of operation of a knee lifter and the zigzag width in a case where maximum and minimum zigzag widths are set by the zigzag width setting apparatus in the present invention.

FIG. 3 shows three setting examples A, B, and C of the minimum value and the maximum value. FIG. 4 illustrates an example of control in which the needle 62 is moved in a zigzag pattern in response to the operation of the knee lifter 2 on the basis of these set values. FIG. 4 illustrates a relationship between the amount of operation of the knee lifter 2 and the zigzag width of the needle 62.

In the example of A, since the minimum value is 1 mm, control is made to achieve the zigzag stitch in a zigzag width of 1 mm with an amount of operation of the knee lifter 2 of zero. From then onward, the zigzag width varies linearly in accordance with the operation of the knee lifter 2 to cause the zigzag stitch to be performed in the zigzag width of 9 mm, which is the maximum width, with the amount of operation of the knee lifter 2 of the maximum value MAX.

In the set examples of B and C as well, the zigzag stitches in zigzag widths of 2 mm and 3 mm are performed with the amount of operation of the knee lifter 2 of zero and the zigzag stitches in zigzag widths of 7 mm and 5 mm are performed with a maximum amount of operation MAX of the knee lifter 2.

As is understood from FIG. 4, in C and B where the amplitude range is smaller than A, amount of changes of zigzag width with respect to the amount of operation of the knee lifter 2 become small, and fine control of the zigzag width is enabled.

By setting the knee lifter 2 to MAX or the ZERO position, stitches are performed in the zigzag widths of the preset maximum value or minimum value, and fine adjustment is not necessary, and stitching with high stability is realized with a simple operation. In particular, since the operation is not necessary specifically at the ZERO position, the zigzag stitch at the minimum value is enabled by setting the minimum value without operating the knee lifter 2.

Figure 5:
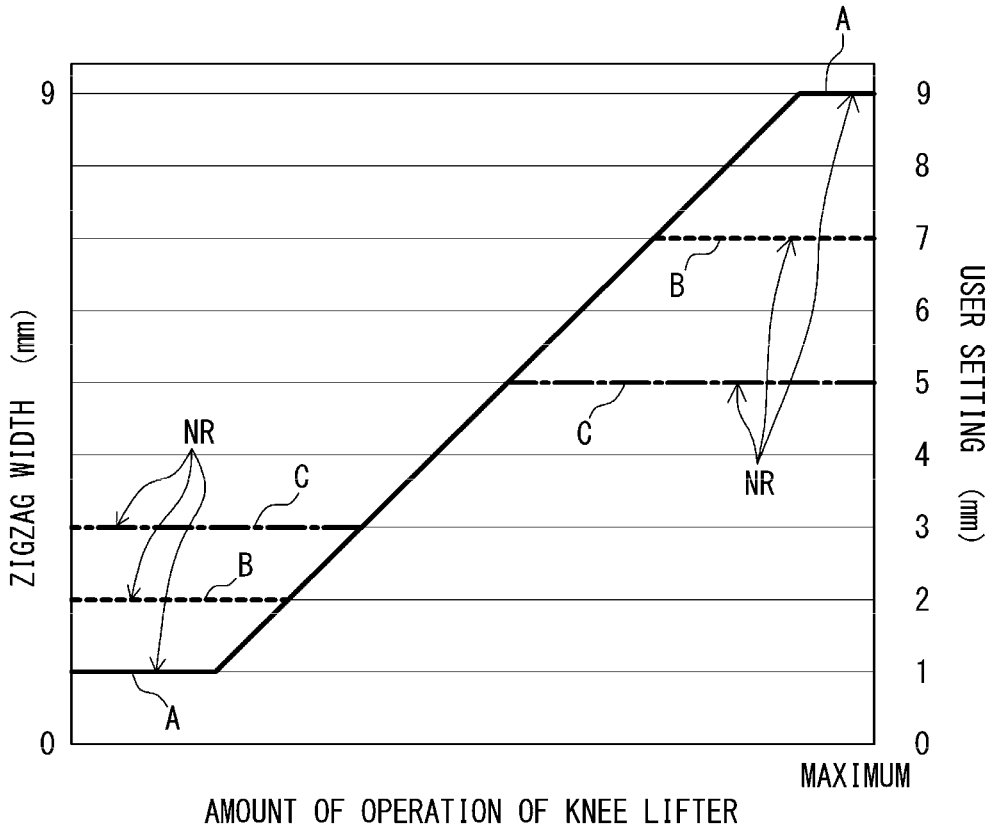
FIG. 5 A graph illustrating another relationship between an amount of operation of the knee lifter and the zigzag width in a case where the maximum and minimum zigzag widths are set by the zigzag width setting apparatus in the present invention.

FIG. 5 illustrates another control example. Here, a non-sensitive area NR in which the zigzag width does not change is provided between the amount of operation of zero to a predetermined amount of operation of the knee lifter 2, a non-sensitive area NR is provided as well in the predetermined amount of operation before the amount of operation MAX of the knee lifter 2 in the same manner, and the amount of operation of the knee lifter 2 and the zigzag width are varied on the identical straight line between the maximum and minimum set values of A, B, and C in an intermediate area.

In this control, the same sense of operation is advantageously obtained since the relationship between the amount of operation of the knee lifter 2 and the zigzag width is the same even though the set values of the maximum value and the minimum value are different.

In the controller 1, control in FIG. 4 and control in FIG. 5 can be switched on the basis of a selection of the operator.

Setting the minimum value and the maximum value by the zigzag width range setting apparatus 9 is also possible during the stitching operation, and this configuration improves flexibility of the stitching operation.

For example, the zigzag width with an operation of the knee lifter 2 of zero can be varied sequentially, so that the zigzag width can be changed while maintaining the knee lifter 2 at the zero position. With the sequential variation of the zigzag width of the maximum value during the stitching operation, a free motion stitch in which the zigzag width is increasing or decreasing is allowed while maintaining the knee lifter 2 at the MAX position.

The controller 1 controls the entire sewing machine, and is configured to achieve functions as the zigzag needle motion controller and the presser controller.

A mode switching apparatus 10 is connected to the controller 1 so that the operator can switch the mode of the controller 1.

One mode is a normal mode, in which only control of the presser lifting mechanism 8 is performed on the basis of the operation of the knee lifter 2, and the presser bar 80 is moved upward and downward by the operation of the knee lifter 2 only to move the presser foot 81 upward and downward. The controller 1 functions only as the presser controller and, in this mode, the operator operates the knee lifter 2 to perform only upward and downward movement of the presser foot 81.

Another mode is a free motion stitch mode, which is a mode to selectively control the zigzag motion mechanism 7 and the presser lifting mechanism 8 by the operation of the knee lifter 2. In the mode the controller 1 selectively achieves the function as the zigzag needle motion controller and the function as the presser controller. This selection is performed by the controller 1 on the basis of a determination from a signal from the upper shaft phase detecting apparatus 3.

When it is determined from the signal from the upper shaft phase detecting apparatus 3 that the sewing machine is stopped, the controller 1 functions as the presser controller and when the operator operates the knee lifter 2, the operation is detected by the operation detecting apparatus 20 and, simultaneously, the state of the presser bar 80 is detected from the presser detecting apparatus 4 to control the presser lifting mechanism 8 to move the presser foot 81 upward or downward.

In contrast, when it is determined from the signal from the upper shaft phase detecting apparatus 3 that the sewing machine is in operation, the controller 1 functions as the zigzag needle motion controller and, when the operator operates the knee lifter 2, the operation and the amount of operation are detected by the operation detecting apparatus 20 and the zigzag motion mechanism 7 is driven, whereby the needle 62 is moved in the zigzag width in accordance with the amount of operation.

As described above, whether the sewing machine is in operation or stopped is determined from the signal from the upper shaft phase detecting apparatus 3, so that contents of control is changed by the operation of the knee lifter 2 correspondingly. In other words, when the sewing machine is in operation, the presser foot 81 is not needed to move upward and downward and the zigzag motion mechanism 7 is controlled if the sewing machine is in operation. When the sewing machine is stopped, since the needle 62 is not moved in the width direction, so that the presser lifting mechanism 8 is controlled.

In this embodiment, at the time of the free motion stitch, the controller 1 is configured to control the motor 6 simultaneously, thereby performing the control of the stitching speed of the sewing machine simultaneously. When the zigzag motion mechanism 7 is controlled to move the needle 62 in the width direction, control is made to reduce the speed of the sewing machine, while when the needle 62 is not moved in the width direction, control is made to increase the speed of the sewing machine. Accordingly, improvement in workability and improvement in stitching quality are achieved.

Figure 6:
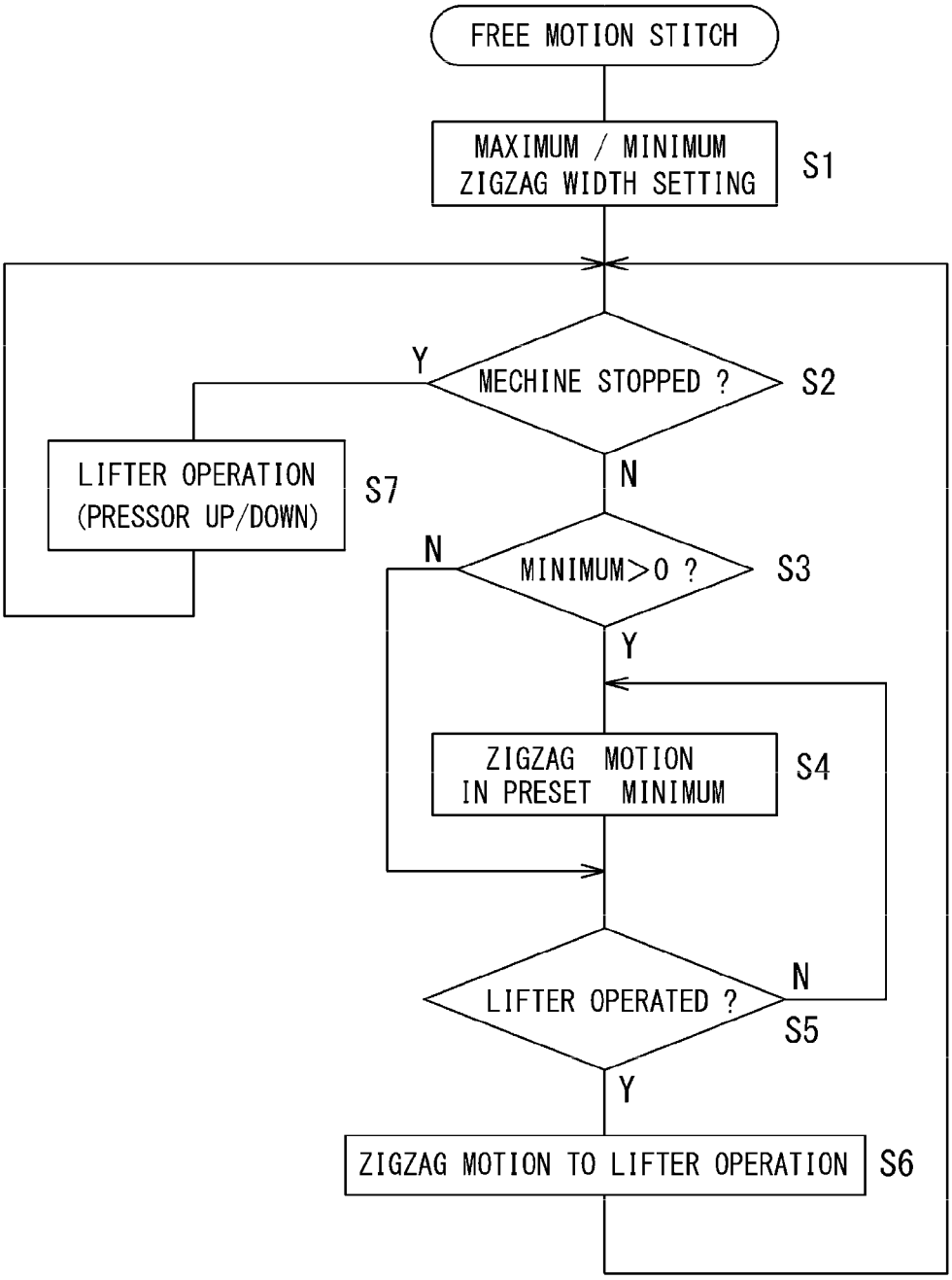
FIG. 6 A flow chart illustrating an operation of the embodiment of the present invention.

An operation will be described with reference to FIG. 6.

The operator firstly switches the mode of the controller 1 to the free motion stitch mode by the mode switching apparatus 10, and subsequently set the minimum value and the maximum value of the zigzag width of the needle 62 by the zigzag width range setting apparatus 9 (Step S1).

The controller 1 determines whether or not the sewing machine is stopped from the signal from the upper shaft phase detecting apparatus 3 (Step S2). When the sewing machine is stopped, only the control of the presser lifting mechanism 8 is performed by the operation of the knee lifter 2 (Step S7).

If the sewing machine is not stopped but in operation in Step S2, whether or not the minimum value of the zigzag width set by the zigzag width range setting apparatus 9 is higher than 0 is confirmed (Step S3). If the value is higher than 0, at no operation of the knee lifter 2 (the amount of operation of zero), the zigzag operation in a minimum zigzag width is performed (Step S4). If the minimum value is 0, the zigzag width of the needle 62 is 0 at the zero amount of operation of the knee lifter 2, and the zigzag operation is not performed.

If the operation of the knee lifter 2 is detected (Step S5), the zigzag motion mechanism 7 is controlled by the operation of the knee lifter 2, so that zigzag stitching is performed by moving the needle 62 in accordance with the amount of operation of the knee lifter 2 (Step S6). If the maximum value is changed by the zigzag width range setting apparatus 9 during the sewing machine stitch operation, the zigzag stitch in accordance with the changed maximum zigzag width is performed. Therefore, when setting the amount of operation of the knee lifter 2 to the maximum value MAX and performing the zigzag stitch in the maximum value of the zigzag width, a zigzag stitch such that the width of the zigzag stitch gradually increases or gradually decreases while changing the maximum value by the zigzag width range setting apparatus 9 can be performed with high stability, so that the stitch with good appearance is obtained.

At the same time, speed control of the motor 6 in accordance with the zigzag width is also possible.

If the fact that the sewing machine is stopped is detected from the signal from the upper shaft phase detecting apparatus 3 (Step S2), the procedure goes to Step S7. In Step S7, the presser foot 81 moves upward or downward by the operation of the knee lifter 2.

In the embodiment described above, control of the zigzag width with high stability within a range of the zigzag width required by the operator is achieved by setting the range of the controllable zigzag width by the zigzag width range setting apparatus 9. In addition, when the minimum value is set by the zigzag width range setting apparatus 9, the zigzag stitch in the minimum zigzag width is achieved without performing the operation of the knee lifter 2. Further, by setting the maximum value by the zigzag width range setting apparatus 9, the zigzag stitch in the preset maximum zigzag width is achieved by fixing the amount of operation of the knee lifter 2 to the maximum position MAX. Therefore, adjustment of the amount of operation of the knee lifter 2 is not necessary, and the zigzag stitch in the stable zigzag width is advantageously performed.

In addition, a burden of the operator is dramatically reduced because both of the upward and downward movement of the presser foot 81 in accordance with the operating state of the sewing machine, and the widthwise movement of the needle 62 can be performed by using the knee lifter 2 operated by the knee of the operator. In particular, the effects are significant since the two functions can be achieved by the operation of the knee in the free motion stitch in which the operator moves the cloth freely when performing stitching. In addition, in the case where the speed control of the motor 6 is performed in accordance with the zigzag width of the needle 62, occurrence of irregular stitching or broken thread may be effectively prevented.

REFERENCE SIGNS LIST

1: controller, 2: knee lifter, 3: upper shaft phase detecting apparatus, 4: presser detecting apparatus, 6: motor, 7: zigzag motion mechanism, 8: a presser lifting mechanism, 9: zigzag width range setting apparatus, 10: mode switching apparatus, 20: operation detecting apparatus, 21: knee pad portion, 22: lever, 23: link mechanism, 24: potentiometer, 60: main shaft, 61: needle rod lifting mechanism, 62: needle, 65: needle rod supporting member, 70: zigzag motion motor, 71: zigzag motion gear, 72: zigzag motion rod, 80: presser bar, 81: presser foot, 82: stepping motor, 83: lever

The invention claimed is:

1. A sewing machine comprising:

a zigzag motion mechanism for causing a zigzag needle motion, an operating apparatus operated by an operator for controlling a zigzag width of a zigzag needle motion by the zigzag motion mechanism, an operation detecting apparatus for detecting an operation of the operating apparatus and an amount of the operation thereof, a zigzag width range setting apparatus for setting a range of zigzag widths that can be operated by the operating apparatus, and a zigzag needle motion controller for controlling the zigzag motion mechanism when the operation of the operating apparatus is detected by the operation detecting apparatus, and causing the zigzag motion mechanism to perform the zigzag needle motion in accordance with the amount of operation of said operation apparatus and within the zigzag width range set by the zigzag width range setting apparatus, wherein said zigzag width range setting apparatus is configured to set a zigzag width range within a range of zigzag widths that can be performed by said zigzag motion mechanism, and is configured to set any value of the zigzag width within said zigzag width range as a value to be used when said operating apparatus is not actuated.

2. The sewing machine according to claim 1, wherein said zigzag width range setting apparatus is capable to set a maximum value of the zigzag width.

3. The sewing machine according to claim 1, wherein said operating apparatus is a knee lifter that an operator moves by using the operator's knee.

4. The sewing machine according to claim 1, wherein said controller controls zigzag width of the zigzag motion mechanism linearly to the amount of operation of the operating apparatus within the zigzag width range.

5. The sewing machine according to claim 1, wherein the controller controls with a provision of a range of the amount of operation in which the zigzag width of the zigzag motion mechanism is constant with respect to the amount of operation of the operating apparatus within the zigzag width range.

6. The sewing machine according to claim 1, further comprising:

a sewing machine operating speed controller for controlling an operating speed of the sewing machine corresponding to the zigzag width of the zigzag needle motion by the zigzag motion mechanism.

7. The sewing machine according to claim 1, comprising:

a presser lifting mechanism, a state detecting apparatus for detecting whether a needle of the sewing machine is in an operating state or in a stop state, and a presser controller for controlling the presser lifting mechanism to move a presser upward and downward in accordance with the operation if the needle of the sewing machine is detected to be in the stop state by the state detecting device when the operation of the operating apparatus is detected by the operation detecting apparatus, wherein said zigzag needle motion controller controls the zigzag motion mechanism to cause the zigzag needle motion in accordance with said amount of operation if the needle of the sewing machine is detected to be in the operating state by the state detecting device when the operation of the operating apparatus is detected by the operation detecting apparatus.

8. The sewing machine of claim 1, wherein the extent of the actuation of said operating apparatus determines the value of the zigzag width within said zigzag width range.

* * * * *